United States Patent [19]

Fuchs et al.

[11] Patent Number: 4,603,424

[45] Date of Patent: Jul. 29, 1986

[54] FLUID-COOLED CARRIER MEMBER OF A COMPOSITE ELECTRODE OF AN ELECTRIC ARC FURNACE

[75] Inventors: Gerhard Fuchs, Kehl-Bodersweier; Joachim Ehle, Lautenbach; Helmüt Karcher, Rheinau-Freistett; Klaus Kimmer, Willstätt-Sand, all of Fed. Rep. of Germany

[73] Assignee: Fuchs Systemtechnik GmbH, Fed. Rep. of Germany

[21] Appl. No.: 676,170

[22] Filed: Nov. 29, 1984

[30] Foreign Application Priority Data

Dec. 7, 1983 [DE] Fed. Rep. of Germany ..... 3344283
Jul. 13, 1984 [DE] Fed. Rep. of Germany ..... 3425891

[51] Int. Cl.[4] ..... H05B 7/06
[52] U.S. Cl. ..... 373/93
[58] Field of Search ..... 373/93, 92, 91, 94

[56] References Cited

U.S. PATENT DOCUMENTS 4,168,392 9/1979 Prenn ..... 373/93
4,495,624 1/1985 Reimpell et al. ..... 373/93

FOREIGN PATENT DOCUMENTS 426849 10/1948 Italy ..... 373/93

*Primary Examiner*—Roy N. Envall, Jr.

[57] ABSTRACT

In a fluid-cooled clamp member (1) of a composite electrode (2) of an electric arc furnace, disposed in the flow path (13) for the coolant is a shut-off device (14) which is biassed in the closure direction, having an actuating member (15) by means of which the shut-off device (14) is put into the open condition in opposition to the biassing force, when a replaceable lower portion (2) of the composite electrode, which is subject to burning away, is screwed on. In the event of fracture of the lower portion in the region of the nipple (5), the flow path (13) is closed off by the actuating member (15) being released. The screwthreaded nipple is additionally protected by means of a protective cap which is screwed on to the screwthreaded nipple, the cap having an external screwthread corresponding to the internal screwthread of the lower portion (2).

23 Claims, 8 Drawing Figures

Figure 4:
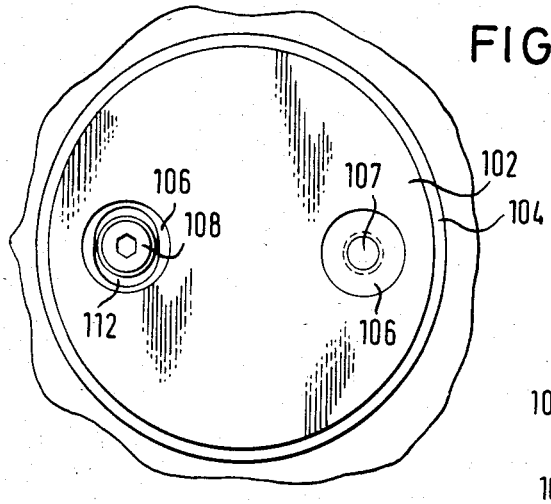

FIG. 2
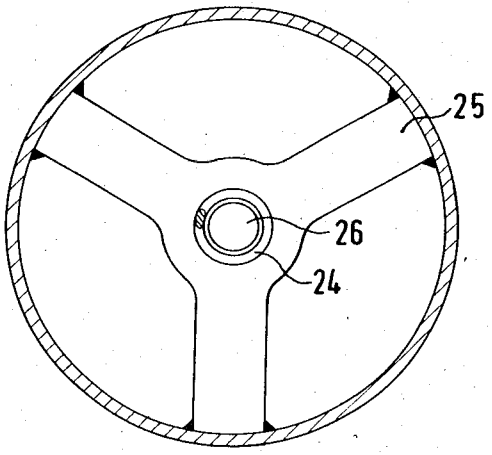
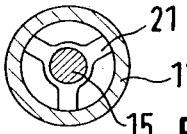
FIG. 3
FIG. 1
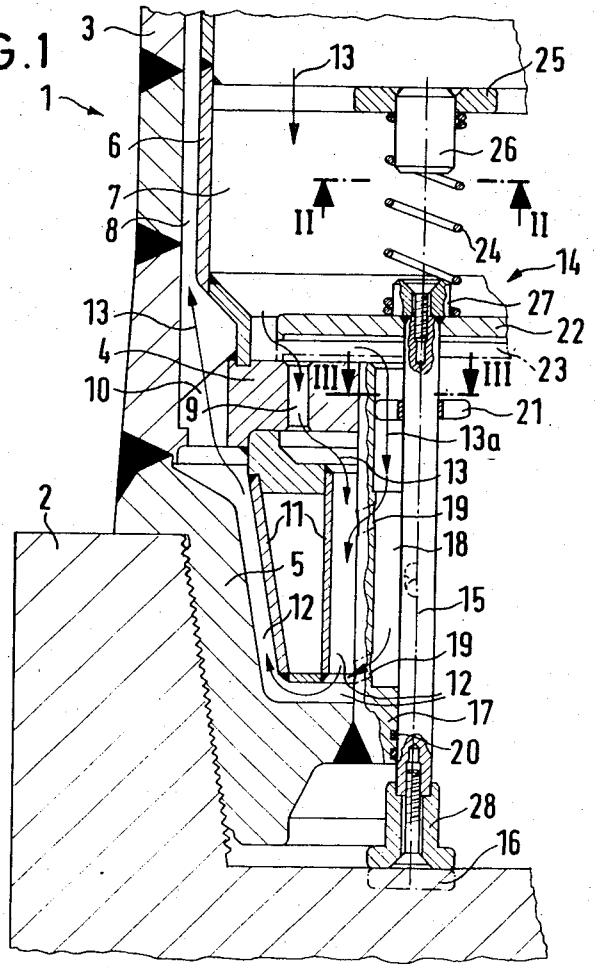

FLUID-COOLED CARRIER MEMBER OF A COMPOSITE ELECTRODE OF AN ELECTRIC ARC FURNACE

The invention relates to a cylindrical clamp member of a composite electrode.

In the clamp member of that kind, which is disclosed in No. EP-B1-0010305, secured to the lower end is a screwthreaded portion or a nipple, for screwing on a replaceable lower portion which is made of graphite and which is subject to burning off. The screwthreaded portion has ducts for the coolant, the ducts being supplied with the coolant by way of the cooling system of the clamp member. In one embodiment of the known mounting arrangement, the cooling system which carries the electrode current and the cooling fluid includes an inner metal tube which is fitted into an outer metal tube at a spacing therefrom, the annular space defined between the two tubes communicating with the interior of the inner metal tube in the lower region of the clamp member. The coolant, being generally water, is fed to the interior of the inner metal tube by way of connection, above the point at which the clamp member is gripped, flows downwardly into the region of the screwthreaded portion and is there returned into the annular space which is defined between the two metal tubes and which, above the point at which the clamp member is gripped in position in the crosshead, includes a further connection for the discharge of the cooling water. Disposed outside the clamp member in the cooling water feed or in the cooling water return is a device for measuring the amount of cooling water which, when the rate of coolant through-put falls below a prescribed value, produces an alarm signal which can be used to pull the clamp member upwardly by way of the electrode control system.

When a composite electrode with a clamp member of the above-indicated kind is used in an electric arc furnace in which scrap metal is being melted down, mechanical loadings can have the effect that the replaceable lower portion fractures in the region of the screwthreaded portion or nipple and then the composite electrode is moved further downwardly by the electrode control system, which generally results in damage to the lower tip of the clamp member, which is now no longer protected, and possibly also results in the cooling fluid escaping.

The object of the present invention is to provide a clamp member with a signalling means which, in the event of fracture of the replaceable lower portion in the region of the screwthreaded portion or nipple, produces a signal which can be utilised for raising the clamp member. In addition, the invention seeks to provide that, in that case, the feed flow of coolant can be immediately interrupted in order to minimise the amount of coolant that escapes, in the event of damage to the lower tip of the clamp member.

The invention further seeks to provide that, in the event of fracture of the replaceable lower portion in the above-mentioned region, the screwthreaded portion is protected from damage and thus the required maintenance operations on the clamp member are substantially reduced.

In accordance with one aspect of the invention, in the clamp member of the composite electrode, disposed in the coolant flow path is a shut-off or closure means which is biassed in the closure direction, having an actuating member by means of which the shut-off means can be moved into the opened condition against the biassing force when a replaceable lower portion is screwed on to the screwthreaded portion. Thus, the flow path is closed when the lower portion is removed and opened when the lower portion is screwed on. If the lower portion is forcibly removed in the event of electrode fracture at the location of the screwthreaded portion or nipple, then the biassing force of the shut-off means provides that the flow path is immediately closed off, in other words, the throughflow of coolant is abruptly interrupted and, when using an incompressible coolant such as water, that control operation has its effect immediately at any point in the flow path and can thus be utilised as an alarm signal in respect of electrode fracture and a control signal for the electrode control system. That means that there are no additional cables or leads for an alarm system. Preferably, the shut-off means is disposed in the flow path of the feed to the lower tip of the clamp member and a flow meter for detecting the closed condition of the shut-off means is disposed in the feed to the clamp member so that, in the event of damage to the unprotected tip after electrode rupture and coolant escape at that point not only does the alarm system remain intact but in addition the feed of coolant to the damaged location is interrupted. The shut-off or closure means therefore performs two functions, on the one hand being a signal generator for the flow meter which is disposed in the coolant feed and which in turn supplies a control signal to the electrode control system, while on the other hand the shut-off means is a closure member which cuts off the feed flow of coolant to the damaged part of the tip of the clamp member. In that way, the coolant which is contained in the flow path up to the shut-off member can be held back and prevented from being discharged into the furnace.

In accordance with another aspect of the invention, the screwthreaded portion or screwthreaded nipple on to which the lower portion of the combination electrode is screwed is protected by a protective cap which preferably comprises graphite and which has an outside screwthread on to which the lower portion of the electrode can be screwed. The protective cap then forms an intermediate member which remains on the screwthreaded nipple in the event of fracture of the lower portion of the electrode in the region of the screwthreaded nipple, and protects the screwthreaded nipple from damage by arcs. The damaged protective cap can be quickly and easily replaced by unscrewing it from the screwthreaded nipple of the clamp member. The cap is an inexpensive element which, in the case of screwthreaded nipples which are of a conical or tapered configuration, can also be screwed on to already existing fluid-cooled clamp members. Preferably, the two aspects of the invention as set forth above are combined, that is to say, besides the protective cap, the arrangement also has the shut-off means described in this application.

Figure 7:
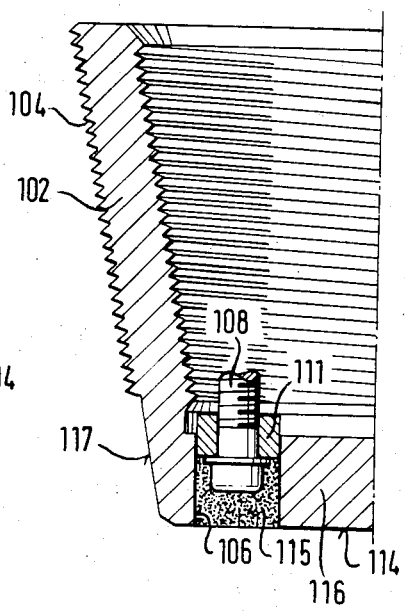
Figure 5:
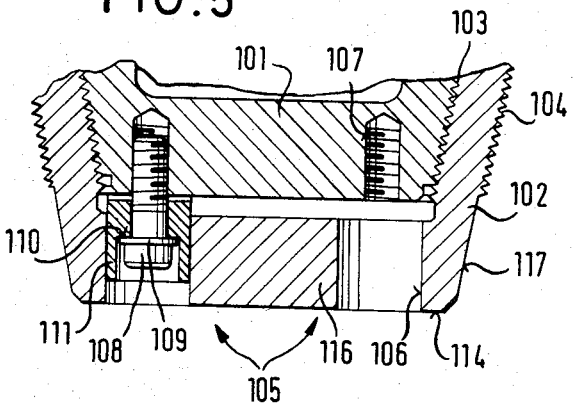
Figure 8:
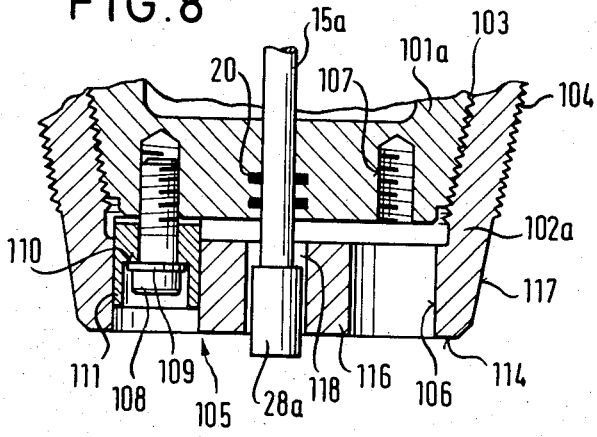
Figure 6:
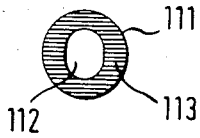

The invention will now be described by means of three embodiments with reference to the eight figures of accompanying drawings in which:

FIG. 1 is a view in longitudinal section of part of a fluid-cooled clamp member with screwed-on lower portion of a composite electrode, FIG. 2 is a view in section taken along line II—II in FIG. 1, FIG. 3 is a view in cross-section taken along line III—III in FIG. 1, FIG. 4 is a view of the screwthreaded portion of a fluid-cooled clamp member with protective cap screwed thereon, from below, FIG. 5 is a view in longitudinal section of a part of the screwthreaded portion of the clamp member and the protective cap screwed thereon, FIG. 6 is a view of the end, which bears against the screwthreaded portion, of the sleeve member shown in FIG. 5, FIG. 7 is a view in longitudinal section of half of a protective cap, and FIG. 8 is a view corresponding to that shown in FIG. 5, with an actuating member as shown in FIG. 1.

The fluid-cooled clamp member illustrated in FIG. 1, for a replaceable lower portion 2, which is liable to be burnt away, of a composite electrode of an electric arc furnace includes an exposed outer metal tube 3 whose upper portion is of approximately the same diameter as the lower portion 2 of the electrode and which can be gripped in position in an electrode crosshead of an electric arc furnace. At the end remote from the gripping location, that is to say, at its lower end, the metal tube 3 carries a flange 4 and a screwthreaded portion 5 for screwing on the lower portion 2. The diameter of the lower portion of the metal tube 3, which in the operating condition extends into the interior of the furnace, is reduced in relation to the diameter of the lower portion 2.

Disposed at a spacing from the outer metal tube 3 is an inner metal tube 6. The space or cavity 7 in the inner metal tube serves as a duct for the feed flow of coolant, preferably cooling water, to the fluid-cooled screwthreaded portion 5. The return flow of cooling water is by way of the space 8 defined between the outer and inner metal tubes. At the upper end of the fluid-cooled clamp member 1, the space 7 communicates with a connection for the supply line (feed) and the space 8 communicates with a connection for the return (return flow) of the coolant.

The electrode current is introduced into the upper portion of the outer metal tube 3, and is carried downwardly in the metal tube 3 which comprises steel, and pases by way of the screwthreaded portion 5 which comprises electrolytic copper, into the lower portion 2 which is fitted on to the nipple.

A number of inner bores or holes 9 and a number of outer bores or holes 10 are provided in the flange 4. The bores 9 are distributed in a circular array around the centre line of the clamp member 1 and are connected to the space 7, while the bores 10 are also distributed in a circular array of larger diameter around the centre line and communicate with the space 8. The bores serve as ducts for the feed and discharge flow of coolant, to and from the duct 12 which is defined in the screwthreaded portion 5 by an annular displacement member 11. The flow path for the coolant is indicated by arrows 13.

In accordance with the invention, disposed in the flow path 13 is a shut-off means 14 which is biassed in the shut-off or closure direction, having an actuating member 15. When the lower portion 2 is screwed on to the screwthreaded portion 5, the flow path 13 is opened by the actuating member 15 while when the lower portion 2 is removed, the flow path is closed off. For that purpose, with the shut-off means 14 in the closed condition, the actuating member 15 projects out of the screwthreaded portion 5, as indicated in FIG. 1 by the dash-dotted position shown at 16, into a region which, when the lower portion is screwed on to the screwthreaded portion, is occupied by a region of the lower portion. The important consideration is that, when the lower portion 2 is screwed on, the actuating member 15 is actuated in opposition to the biassing force of the shut-off means, by any region of the lower portion or a member which is disposed on the lower portion, as a result of which the flow path 13 is opened.

A preferred embodiment of the shut-off means will be described in detail hereinafter.

The actuating member 15 of the shut-off means 14 is in the form of a rod which is guided within a sleeve 17 which is fixed coaxially in the flange 4 and in the screwthreaded portion 5, being welded to those components in the illustrated embodiment. With the exception of the lower part, the sleeve 17 is disposed around the actuating member 15 at a spacing therefrom so that an annular duct 18 for the coolant is formed between the actuating member 15 and the sleeve 17. The duct 18 communicates with the duct 12 by way of ducts 19. In that way, the flow path 13 has a branched-off or diversion portion as indicated at 13*a*. Good cooling for the actuating member 15 can be achieved by way of the branch portion 13*a* of the flow path. The actuating member 15 is guided by the lower part of the sleeve 17 which has annular seals 20 in order to prevent the coolant from escaping, and by a guide element 21 which is fitted into the sleeve 17 and which is of the form shown in FIG. 3.

At its upper end, the actuating member 15 carries a plate-like shut-off member 22 which is welded thereonto. When the lower portion 2 is removed, with the actuating member 15 occupying the position shown in dash-dotted lines at 16, the shut-off member 22 assumes the position which is also illustrated in dash-dotted lines and indicated at 23, in which it closes the inner bores 9 and the annular duct 18 of the sleeve 17 and thus blocks the flow path 13. When the lower portion 2 is removed, the shut-off member 22 is moved into the closure position by a biassing force which is produced on the one hand by the fluid pressure in the space 7 in the inner metal tube 6 and on the other hand by a compression spring 24 which bears against a holder 25. The holder 25, the configuration of which is shown in FIG. 2, is fixed in the lower part of the inner metal tube 6, being welded thereto in the illustrated embodiment, and carries a guide spigot or projection 26 for the compression spring 24. The compression spring 24 bears against the plate-like shut-off member 22 where it is also guided by a spigot or projection 27 which is screwed thereto. The lower end of the actuating member which, in the event of electrode fracture, is directly exposed to the atmosphere in the furnace, is of an easily replaceable construction. In the present case, it comprises an end member 28 which is screwed thereon.

In the operative condition, the shut-off means occupies the position shown in solid lines in FIG. 1. In the event of fracture of an electrode, that is to say, fracture of the lower portion 2 which preferably comprises graphite, in the region of the nipple, the actuating member 15 is released and the plate-like shut-off member 22, together with the actuating member 15, is urged downwardly by the fluid pressure in the space 7 and by the force of the compression spring 24, whereby the feed flow to the inner bores 9 and to the annular duct 18 is abruptly interrupted. When the coolant is an incompressible coolant such as water, that switching operation is registered virtually without any time delay by a monitoring means in the coolant feed system, and a control signal is supplied to the electrode control system which immediately pulls the clamp member in question upwardly. If the screwthreaded portion 5 should suffer damage as a consequence of the fracture of the electrode, the fluid in the space 7 is prevented from escaping by the plate-like shut-off member 22.

Of the rod-like or bar-like, fluid-cooled clamp member with screwthreaded nipple 101 for screwing on the replaceable lower portion of a composite electrode, FIG. 5 shows only the screwthreaded nipple 101. In the illustrated embodiment, it comprises copper and, as in the case of the first embodiment, is welded to the lower end of the clamp member which includes a metal cooling system for carrying the electrode current. The screwthreaded nipple 101 has ducts (also not shown) for the coolant, which are supplied with the coolant by way of the cooling system of the clamp member. The screwthreaded nipple is of a conical or tapered configuration in the usual fashion and is provided with an outside screwthread corresponding to the inside screwthread of the replaceable lower portion of the composite electrode.

A protective cap 102 of graphite or a refractory material is screwed on to the screwthreaded nipple 101. For that purpose, the protective cap 102 has an inside screwthread corresponding to the outside screwthread on the screwthreaded nipple 101, that is to say, it has a screwthread which is identical to the inside screwthread of the lower portion which otherwise is to be screwed on to the nipple 101. The screwthread connection is denoted by reference numeral 103.

In the same manner as the screwthreaded nipple 101, the protective cap 102 is of a conical or tapered configuration and is provided at its outside peripheral surface with an outside screwthread 104 which corresponds to the inside screwthread in the lower portion of the composite electrode, which is to be screwed on to the protective cap 102. A means as indicated at 105 is provided for preventing rotary movement as between the protective cap 102 and the screwthreaded nipple 101.

In the illustrated embodiment, the securing means 105 comprises two eccentrically and diametrally disposed holes 106 which extend through the end portion of the protective cap 102 and two correspondingly arranged screwthreaded holes 107 which are provided in the end face of the screwthreaded nipple 101 and into each of which a respective screw 108 is screwed. The head of the screw 108 bears by way of a washer 109 against a shoulder 110 in a sleeve member 111 which preferably comprises refractory material and whose outside diameter is adapted to the diameter of the hole 106. As FIGS. 4 and 6 show, the sleeve member 111 has a slot 112 which is stepped in the axial direction of the sleeve member 111 and thus forms the shoulder 110. Tolerances in the screwthread connection 103 can be compensated for, by means of the slot 112. In order to improve the adhesion between the sleeve member 111 and the end face of the screwthreaded nipple 101, the end face of the sleeve 111 which bears against the face of the screwthreaded nipple 101 is provided with grooves 113 (see FIG. 6). The sleeve member 111 and the screw 108 are recessed in the end portion 116 of the protective cap 102 and are thus protected in the event of electrode fracture. The space between the recessed screw 108 and the outer end face 114 of the protective cap 102 is filled with refractory ramming material 115. In order to enhance the resistance to fracture or rupture of the protective cap 102, the outside screwthread 104 is turned off, in the region of the end portion 116 as far as the beginning of the inside screwthread, that is to say, there is a screwthread-free portion 117. In the operating condition, the lower portion of the composite electrode is screwed on to the outside screwthread 104 of the protective cap 102.

If the protective cap is damaged after an electrode fracture in the region of the screwthreaded nipple, the damage protective cap 102 is replaced by a fresh protective cap, in the following manner.

Firstly, the two screws 108 and the sleeve members 111 are removed and the damaged protective cap is then unscrewed by means of a key which has two pegs fitting into the holes 106. A fresh protective cap 102 is then screwed on to the screwthreaded nipple 101 with the key. In that position, the screwthreaded bores 107 are in the region of the holes 106 so that, after the sleeves 111 have been inserted, the screws 108 can be screwed in, thus securing the protective cap against rotary movement with respect to the screwthreaded nipple 101. After a fresh lower portion of the composite electrode has been screwed on to the protective cap 102, the fault has been rectified.

FIG. 7 shows a view in longitudinal section of half of the above-described protective cap 102.

Preferably, the protective cap is provided in conjuction with the shut-off means described above with reference to FIGS. 1 through 3. For that purpose, the protective cap and possibly the shut-off means are modified in such a way that the shut-off means can be moved into the open condition when the lower portion of the electrode is screwed on to the protective cap. FIG. 8 shows a corresponding arrangement. In that construction, provided in a protective cap **102*a* is a bore 118 through which is extended an end portion 28*a* which is screwed on to the actuating member 15*a* of the shut-off means 14 (see FIG. 1). In the illustrated closed position of the shut-off means, the end member 28*a* projects beyond the bottom end face of the protective cap 102*a*. when the lower portion 2 (see FIG. 1) of the composite electrode is screwed on, the actuating member 15*a* is urged upwardly and opens the cooling circuit. In the event of fracture of the lower portion in the region of the protective cap 102*a*, the nipple 101*a* is protected while in the event of any damage to the protective cap 102*a* and the end member 28*a*,** those components can be easily and rapidly replaced.

We claim:

1. A cylindrical clamp member (1) of a composite electrode, which clamp member can be fixed to the electrode crosshead of an electric arc furnace and which includes a flow path (13) for a coolant and which at a lower end carries a screwthreaded portion (5) for screwing on a replaceable lower portion (2) of the composite electrode, which lower portion is liable to being burnt away, characterized in that disposed in the flow path (13) is a shut-off means (14) which is biassed in the closure direction, having an actuating member (15) by which the shut-off means (14) can be put into the open condition against the biassing force when the lower portion (2) is screwed on to the screwthreaded portion (5).

2. A clamp member as set forth in claim 1 characterised in that the actuating member (15), in the closed condition of the shut-off means (14), projects from the screwthreaded portion (5) in a region which is occupied by a region of the lower portion (2) when the lower portion is screwed on.

3. A clamp member as set forth in claim 2 characterised in that the shut-off means (14) includes an axially displaceable rod as the actuating member (15), which rod at one end carries a shut-off member (22) which is disposed in the flow path (13), and at the other end projects out of the end of the screwthreaded portion (5).

4. A clamp member as set forth in claim 3 characterised in that the actuating member (15) is guided within a sleeve (17) provided with ducts (18, 19) for the coolant.

5. A clamp member as set forth in claim 1 characterised in that in a lower portion thereof, in the flow path (13) for the coolant, it has a flange (4) through which passes at least one duct (9), and the duct can be closed off by the shut-off means (14).

6. A clamp member as set forth in claim 5 characterised in that the flange (4) has a plurality of ducts (9) which are closable by a plate-like shut-off member (22).

7. A clamp member as set forth in claim 1 characterised in that the shut-off means (14) is biassed by a spring (24).

8. A clamp member as set forth in claim 1 characterised in that the shut-off means (14) is biassed by the pressure of the coolant.

9. A clamp member as set forth in claim 1 characterised in that the screwthreaded portion (5) includes a duct (12) for the coolant, which is disposed in the flow path (13) for said coolant.

10. A clamp member as set forth in claim 5 characterised in that the sleeve member (17) is coaxially fixed in a flange (4) and in the screwthreaded portion (5).

11. A clamp member as set forth in claim 9, characterized in that it includes further ducts (18, 19) in the screwthreaded portion, an inner metal tube (6) and at a spacing therefrom an outer metal tube (3), which metal tubes are closed off and connected in a lower portion thereof by a flange (4) which has ducts (9 and 10) communicating respectively with a space (7) in the inner metal tube (6) and an intermediate space (8) between the two metal tubes (6 and 13), the last named ducts (9 and 10) communicating with the duct (12) for the coolant and the further ducts (18, 19) in the screwthreaded portion respectively, and that at the upper end the clamp member has a connection for the coolant, which communicates with the space (7) in the inner metal tube (6), and a connection which communicates with the space (8) between the two metal tubes (6 and 3).

12. A clamp member as set forth in claim 1 characterised in that there is provided a protective cap (102*a*) which includes an end portion which is screwed on to the screwthreaded portion (101*a*) and which has an outside screwthread (104) corresponding to the inside screwthread of the lower portion (2) to be screwed on, and a rotation-preventing means (105) for preventing rotary movement as between the protective cap (102*a*) and the screwthreaded portion (101*a*), and that the shut-off means (14) can be put into the open condition when the lower portion (2) is screwed on to the protective cap (102*a*).

13. A cylindrical clamp member (1) of a composite electrode, which clamp member can be fixed to the electrode crosshead of an electric arc furnace and which includes a flow path (13) for a coolant and which at a lower end carries a screwthreaded portion (5) for screwing on a replaceable lower portion (2) of the composite electrode, which lower portion is liable to being burnt away, characterised by a protective cap (102) which includes an end portion which is screwed on to and substantially covers the screwthreaded portion (101) and which has an outside screwthread (104) corresponding to the inside screw-thread of the lower portion to be screwed on, and a rotation-preventing means (105) for preventing rotary movement as between the protective cap (102) and the screwthreaded portion (101).

14. A clamp member as set forth in claim 12 characterised in that the outside of the protective cap (102) has a screwthread-free portion (117) in the region of an end portion (116) of the cap.

15. A clamp member as set forth in claim 12 characterised in that the screwthreaded portion (101) and the protective cap (102) are of a tapered configuration.

16. A clamp member as set forth in claim 12 characterised in that the protective cap (102) is secured against rotation by means of at least one screw (108) which is fitted at an eccentric position into an end of the screwthreaded portion (101) and which is countersunk in an end portion (116) of the protective cap (102).

17. A clamp member as set forth in claim 16 characterised in that at least one eccentrically disposed through hole (106) is provided in the end portion (116) of the protective cap (102), wherein a sleeve member (111, 111') whose outside diameter is adapted to the diameter of the hole (106) and which has a slot (112) therein is fitted into said hole (106) as an intermediate member between the head of the screw (108) and the end face of the screwthreaded portion (101).

18. A clamp member as set forth in claim 12 characterised in that the protective cap (102) comprises graphite.

19. A clamp member as set forth in claim 13 characterised in that the outside of the protective cap (102) has a screwthread-free portion (117) in the region of an end portion (116) of the cap.

20. A clamp member as set forth in claim 13 characterised in that the screwthreaded portion (101) and the protective cap (102) are of a tapered configuration.

21. A clamp member as set forth in claim 13 characterised in that the protective cap (102) is secured against rotation by means of at least one screw (108) which is fitted at an eccentric position into an end of the screwthreaded portion (101) and which is countersunk in an end portion (116) of the protective cap (102).

22. A clamp member as set forth in claim 21 characterised in that at least one eccentrically disposed through hole (106) is provided in the end portion (116) of the protective cap (102), wherein a sleeve member (111, 111') whose outside diameter is adapted to the diameter of the hole (106) and which has a slot (112) therein is fitted into said hole (106) as an intermediate member between the head of the screw (108) and the end face of the screwthreaded portion (101).

23. A clamp member as set forth in claim 13 characterised in that the protective cap (102) comprises graphite.

* * * * *

Adverse Decision in Interference

In Interference No. 102,210, involving Patent No. 4,603,424, G. Fuchs, J. Ehle, H. Karcher, K. Kimmer, FLUID-COOLED CARRIER MEMBER OF A COMPOSITE ELECTRODE OF AN ELECTRIC ARC FURNACE, final judgment adverse to the patentees was rendered May 23, 1990, as to claims 1-5 and 7-9.

*[Official Gazette August 28, 1990]*